US009144258B2

(12) United States Patent
Krivanek et al.

(10) Patent No.: US 9,144,258 B2
(45) Date of Patent: Sep. 29, 2015

(54) REALISTICALLY OPENING ARTIFICIAL FLOWER

(75) Inventors: Douglas Lee Krivanek, Lenexa, KS (US); Thomas Allen Wallen, Merriam, KS (US); Gretchen G. Finch, Kansas City, MO (US); Pamela Jean Kelley, Olathe, KS (US); David Morgan Lewis, Overland Park, KS (US); Jamie Lee Heath, Parkville, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 287 days.

(21) Appl. No.: 13/240,675

(22) Filed: Sep. 22, 2011

(65) Prior Publication Data

US 2013/0078395 A1 Mar. 28, 2013

(51) Int. Cl.
*A41G 1/00* (2006.01)

(52) U.S. Cl.
CPC .. *A41G 1/002* (2013.01); *A41G 1/00* (2013.01)

(58) Field of Classification Search
USPC ..... 428/12, 17, 24, 26; 40/411, 427
See application file for complete search history.

(56) References Cited

U.S. PATENT DOCUMENTS 549,039 A 10/1895 Wenger
1,148,208 A 7/1915 Allison
4,708,892 A * 11/1987 Young et al. ..... 428/24
4,738,881 A * 4/1988 Lee ..... 428/12
4,910,647 A 3/1990 Gong
4,973,891 A 11/1990 Tzeng
5,108,800 A * 4/1992 Koo ..... 428/26
5,946,835 A 9/1999 Boyd
6,389,718 B1 * 5/2002 Joo ..... 40/439
7,842,359 B2 11/2010 Marlow
7,861,444 B2 1/2011 Marlow
7,861,445 B2 1/2011 Sui
8,087,991 B2 1/2012 D'Avanzo
2008/0311315 A1 12/2008 Marlow
2008/0311316 A1 * 12/2008 Marlow ..... 428/24
2010/0159162 A1 6/2010 Hao

* cited by examiner

*Primary Examiner* — Nikki H Dees
*Assistant Examiner* — Stephanie Cox
(74) *Attorney, Agent, or Firm* — Shook, Hardy & Bacon L.L.P.

(57) ABSTRACT

A realistically opening artificial flower has a slidable pusher basket having an upper end and a lower end and is moveable from a first position to a second position. The flower includes a means for moving the slidable pusher basket from the first position to the second position; the means is located generally adjacent the lower end of the slidable pusher basket. The flower also includes a simulated flower with a base that receives the upper end of the slidable pusher basket along with multiple rows of petals disposed on a plurality of vertically stacked supports. The slidable pusher basket is coupled with at least one of the plurality of vertically stacked supports via a petal attachment member. Incident to the slidable pusher basket moving from the first position to the second position, the multiple rows of petals transition from the generally closed position to the generally open position, and each row of petals has varying open and closed angles.

19 Claims, 5 Drawing Sheets

REALISTICALLY OPENING ARTIFICIAL FLOWER

BACKGROUND

Although artificial flowers are aesthetically pleasing, their static nature can limit their appeal. There have been attempts to simulate a natural flower by creating an artificial flower that appears to bloom. However, these flowers are often limited to one or two rows of petals, and, moreover, the petals all appear to open to the same degree which heightens the viewer's impression that the flowers are artificial.

SUMMARY

This Summary is provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

Embodiments of the present invention are directed towards a realistically opening artificial flower. At a high level, the invention comprises a container presenting an artificial flower with multiple rows of petals in a closed position. Upon activation of a motion mechanism, the petals gradually open to reveal, in one aspect, a hidden sentiment. Each row of petals has a different opening and closing angle which helps to simulate the appearance of a naturally-blooming flower.

BRIEF DESCRIPTION OF THE DRAWINGS

Embodiments of the invention are described in detail below with reference to the attached drawing figures, wherein.

DETAILED DESCRIPTION

The subject matter of embodiments of the invention disclosed herein is described with specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

In general, the invention is directed towards an artificial flower that opens in such a way as to convey a sense of realism to the viewer. This is achieved by having multiple rows of petals that slowly open upon activation of a motion mechanism. Each row of petals has a different opening angle compared to the other rows, thus mimicking a naturally-blooming flower. After the artificial flower has opened, activation of the motion mechanism causes the multiple rows of petals slowly close. Each row of petals has a different closing angle compared to the other rows which also mimics a naturally-blooming flower. In one embodiment, a sentiment is hidden within the closed petals and is slowly revealed to the viewer when the flower opens.

Figure 1A:
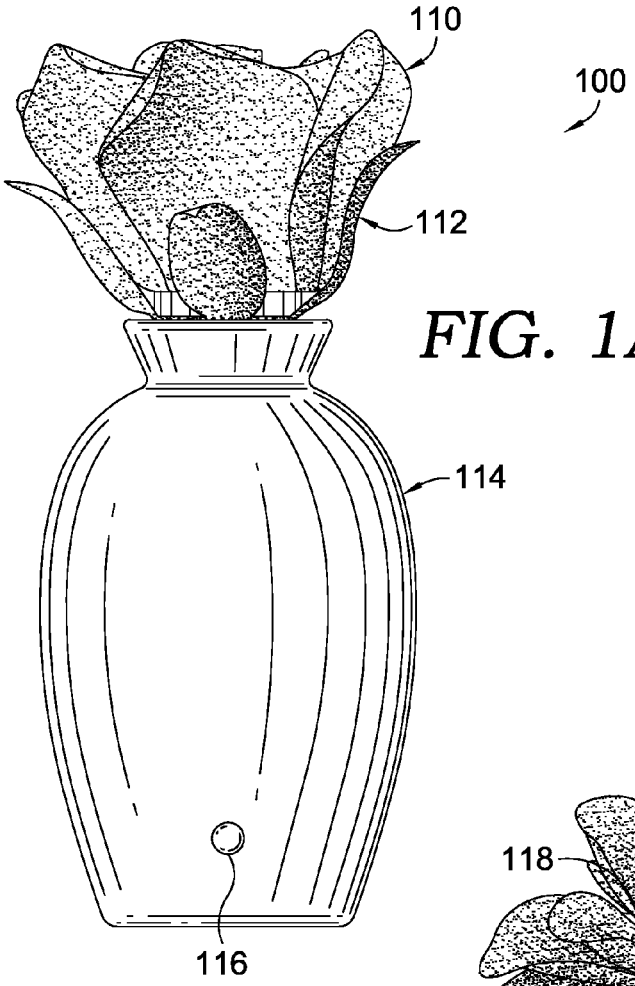
FIG. 1A is a side elevation view of an exemplary realistically opening artificial flower in a generally closed position in accordance with embodiments of the present invention.
Figure 1B:
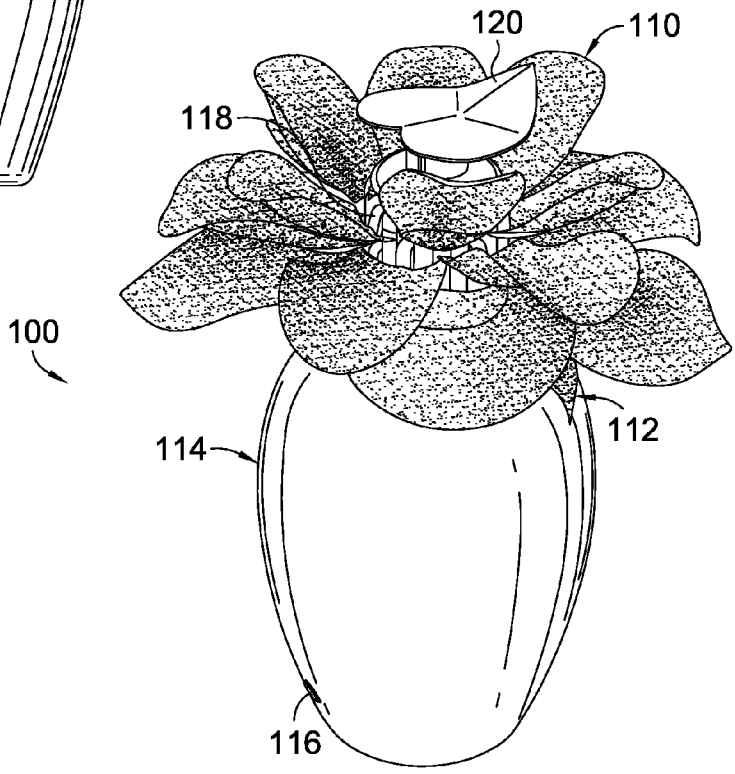
FIG. 1B is a perspective view of the exemplary realistically opening artificial flower in a generally open position in accordance with embodiments of the present invention.

Referring to FIG. 1A, an exemplary realistically opening artificial flower (the flower) 100 is shown in a generally closed position. The flower 100 comprises petals 110, one or more sepals 112, a vase or container 114 and an activating button 116. FIG. 1B depicts the flower 100 in a generally open position. FIG. 1B also depicts a presentation platform 118 and a sentiment 120. Although FIGS. 1A and 1B depict a single flower 100 in a container 114, it is contemplated that the invention could encompass multiple flowers in a vase, a single flower on a stem, multiple flowers on stems, or a flower bloom located on a decorative container. Any and all such variations are within the scope of embodiments of the present invention.

The petals 110 comprise petals of varying shapes, number, colors, and sizes. In one aspect, the petals 110 may be shaped to mimic a naturally-occurring flower such as, for example, a rose or a daisy. Or, alternatively, the petals 110 may be uniquely shaped. The flower 100 may comprise multiple rows of petals 110 with a lowermost row and an uppermost row. In the illustrated embodiment, the flower 100 comprises a bottom row of petals 110, a middle row of petals 110, and a top row of petals 110. The petals 110 in the lowermost row may be of a larger size than a next row of petals 110, and so on, with the smallest sized petals 110 located in the uppermost row of petals 110. Additionally, each row of petals 110 may include a variable number of petals 110.

The petals 110 that make up the flower 100 may be constructed of paper, silk, fabric, or other suitable materials. As well, the petals 110 may be colored to mimic a naturally-occurring flower. The petals 110 are attached to a support structure that will discussed below with respect to FIG. 2. Any and all such variations are within the scope of embodiments of the present invention.

In the illustrated embodiment, the sepals 112 are positioned between the petals 110 and the container 114. The sepals 112 comprise one or more sepals of varying shapes, sizes and colors. The sepals 112 are attached to a base 122 (FIG. 2) of the flower 100. Like the petals 110, the sepals 112 may be constructed of paper, silk, fabric or other suitable materials and be colored to mimic a naturally-occurring sepal. In one aspect, the material that makes up the sepals 112 is also used to cover the base 122 of the flower 100.

The container 114 is used to house a mechanism for opening and closing the flower 110. The container 114 may be constructed of plastic, glass, or other suitable materials and may be shaped to simulate a vase. The container 114 may also be colored. The activating button 116 is located on the container 114 and is readily accessible to a user. In one embodiment, the activating button 116 is located near the bottom edge of the container 114. The activating button 116 is used to actuate the opening and closing of the flower 100. While activation of the mechanism in the illustrated embodiment is caused by user engagement of the activating button 116, other methods of activating the mechanism are within the scope of the present invention. Examples would be sound, light or liquid activation. Other examples would be: using a touch/capacitance sensor on the vase, using a device which detects the presence of water on the stem and then generates an electric signal or current, using a device which detects a pinch of the stem, or using a wireless signal.

The presentation platform 118 is situated adjacent to the uppermost row of petals 110. In one aspect, the presentation platform 118 is affixed to one or more vertical members that are part of the support structure of the flower 100. This aspect will be explained in greater depth below with respect to FIG. 5. The presentation platform 118 is configured to present the sentiment 120 when the flower 100 opens. Before that time, the sentiment 120 remains hidden by the closed petals 110 of the flower 100. The sentiment 120 can be any tangible manifestation of an emotion. Examples include a message, a gift, a ring, a toy, and the like. The sentiment 120 may be affixed to the presentation platform 118 by any affixation technology known in the art. In the illustrated embodiment shown in FIG. 1B, the sentiment 120 comprises a paper message in the shape of a heart. The paper message is formed in such a way as to be folded in a substantially closed arrangement when the petals 110 are in a generally closed position and to unfold to a substantially open arrangement when the petals 110 are in a generally open position. The platform 118 may be stationary, as seen in FIG. 6, or may be a movable platform coupled with the mechanism for opening and closing the flower to lift and/or open the sentiment to enhance the reveal feature. Alternate sentiments can include: a static (non-opening—relying on the petals to conceal it in the closed position) sentiment adorned with moving objects (such as a toy bug like a lady bug or butterfly), a static message of an ink that reveals itself when exposed to light or when wetted, and/or a static message adorned with lights to selectively illuminate the message.

Figure 2:
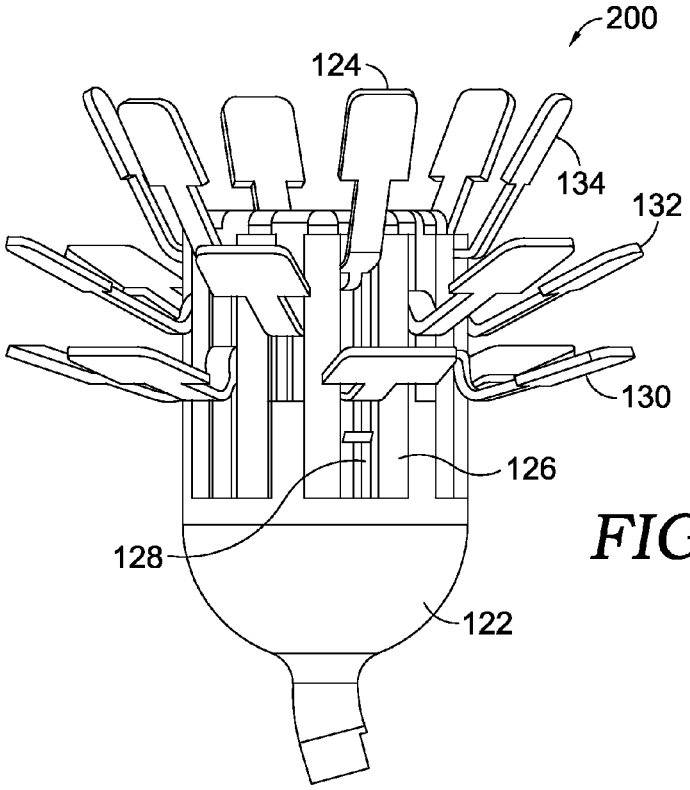
FIG. 2 is an enlarged fragmentary side elevation view of a petal support structure having a base and multiple rows of petal supporting an open position of an exemplary realistically opening artificial flower in accordance with embodiments of the present invention.

Turning now to FIG. 2, a side elevation view illustrates a flower base 122, having a plurality of petal attachment members 124 intermediate a plurality of vertical members 126. This arrangement comprises a support structure 200 for the flower 100. Each pair of vertical members 126 defines an intervening space 128. In the illustrated embodiment, the plurality of petal attachment members 124 are divided into a bottom row 130 of petals 110, a middle row 132 of petals 110, and a top row 134 of petals 110. In one aspect, a portion of the base 122 is partially received in an opening of the container 114 (see FIG. 8). The support structure 200 houses a slidable pusher basket (FIG. 5) that is used to open and close the flower 100. The slidable pusher basket will be explained in greater depth below with respect to FIG. 5. Although three rows of petals 110 are depicted in FIG. 2, it is contemplated that the flower 100 may comprise more or less rows of petals 110.

The petal attachment members 124 of the bottom row 130 of petals 110 are pivotally attached to the one or more vertical members 126 such that an intervening space 128 is left between each of the petal attachment members 124. In turn, the petal attachment members 124 of the middle row 132 of petals 110 are pivotally attached to the one or more vertical members 126 such that they are vertically offset from the petal attachment members 124 of the bottom row 130 of petals 110. The petal attachment members 124 of the top row 134 of petals 110 are pivotally attached to the one or more vertical members 126 so that they are vertically offset from the petal attachment members 124 of the middle row 132 of petals 110 and vertically aligned with the petal attachment members 124 of the bottom row 130 of petals 110.

Figure 4:
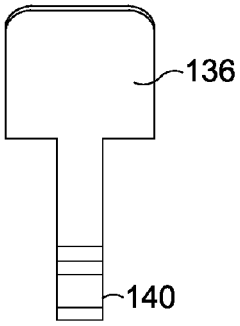
FIG. 4 is a top plan view of a petal attachment member of one of the rows of petal supports of FIG. 3.
Figure 3:
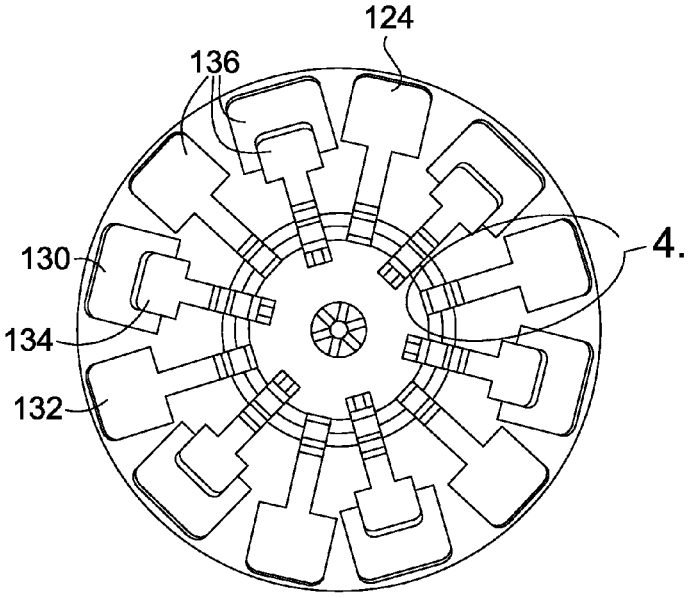
FIG. 3 is a top plan view of the base and the multiple rows of petal supports of FIG. 2.

Turning to FIG. 3, a top plan view of the support structure 200 of FIG. 2 is depicted illustrating the alternating arrangement of the petal attachment members 124. FIG. 4 is a plan view of one of the petal attachment members 124. As can be seen from FIG. 4, the petal attachment member 124 comprises a paddle portion 136, upon which the petal 110 is affixed, a straight portion 138, and a petal pivot portion 140. The petal attachment member 124 comprises some additional portions which are not shown in FIG. 4 because of the perspective; these portions will be discussed with respect to FIG. 7. The petal 110 is affixed to the paddle portion 136 of the petal attachment member 124 by a variety of affixation technologies known in the art such as, for example, glue or other types of adhesives.

The petal attachment members 124 are pivotally attached to the one or more vertical members 126 at the petal pivot portion 140. In one aspect, the pivotal attachment between the petal pivot portion 140 and the one or more vertical members 126 occurs by receiving a horizontal rod 127 spanning between adjacent vertical members 126 in a notch 129 in the petal attachment member 124 adjacent the petal pivot portion 140. The rods 127 provide pivot points for the petal attachment members 124 similar to a fulcrum.

Figure 5:
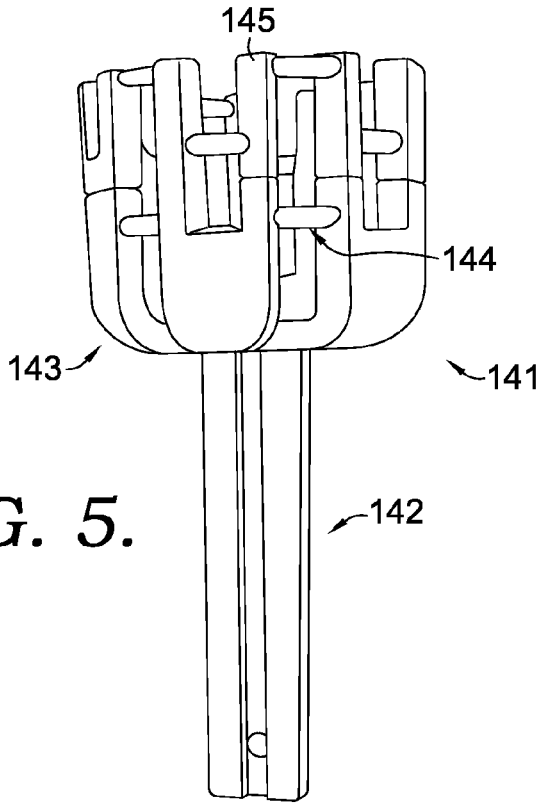
FIG. 5 is a perspective view of a slidable pusher basket in accordance with embodiments of the present invention.
Figure 6:
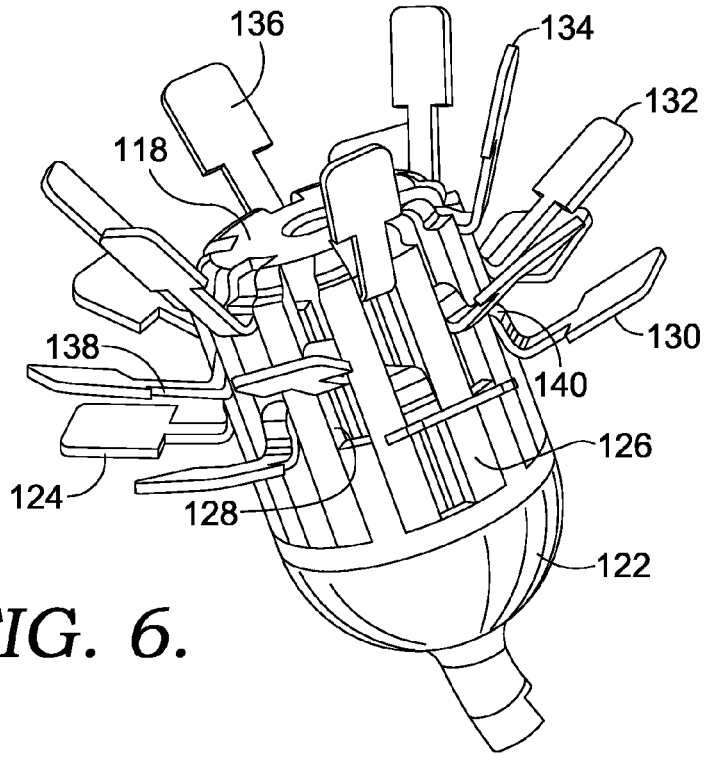
FIG. 6 is a perspective view of the petal support of FIG. 2.

Turning to FIG. 5, a perspective view of a slidable pusher basket 141 is depicted. When assembled, the slidable pusher basket 141 is movably received inside the support structure 200. The slidable pusher basket 141 comprises a slidable pusher shaft 142 and a pusher basket 143. In turn, the pusher basket 143 comprises a series of horizontal segments 144 situated on three different planes, namely, a bottom plane, a middle plane, and a top plane. As well, the pusher basket 143 also comprises a series of vertical supports 145 that connect to the horizontal segments 144. Although the horizontal segments 144 are depicted as being arranged on three different planes, it should be understood that the horizontal segments 144 may be arranged on multiple different planes. In other embodiments of the invention, the slidable pusher shaft 142 may be coupled to one or more vertically stacked circular platforms or rings that, in turn, are operatively coupled to the petal attachment members 124. Any and all such variations are within the scope of embodiments of the present invention.

The horizontal segments 144 are operatively coupled with the petal attachment members 124. More specifically, each row of petal attachment members 124 is associated with a corresponding plane of horizontal segments 144. Each horizontal segment 144 may be received by a petal pivot slot guide of a petal attachment member 124, as discussed in greater detail below with respect to FIG. 7.

When the flower 100 is in a generally open position, as shown in FIG. 1B, the upper end of the pusher basket 143 is located generally adjacent to the uppermost row 134 of the petal attachment members 124. When the flower 100 is in a generally closed position, the upper end of the pusher basket 143 is located generally adjacent to the lowermost row 130 of the petal attachment members 124.

Turning to FIG. 6, an additional view of the support structure 200 is shown. FIG. 6 illustrates how the presentation platform 118 is located generally adjacent to the uppermost row 134 of petal attachment members 124. The presentation platform 118 is affixed to the one or more vertical members 126 by any type of affixation technology known in the art. The presentation platform 118 may be configured in a number of different ways in order to effectively present the sentiment 120. As illustrated, the platform 118 includes an aperture 147 therethrough for receiving a rod (not shown) that can be connected to the pusher basket 143 to raise the sentiment 120 away from the platform 118.

Figure 7:
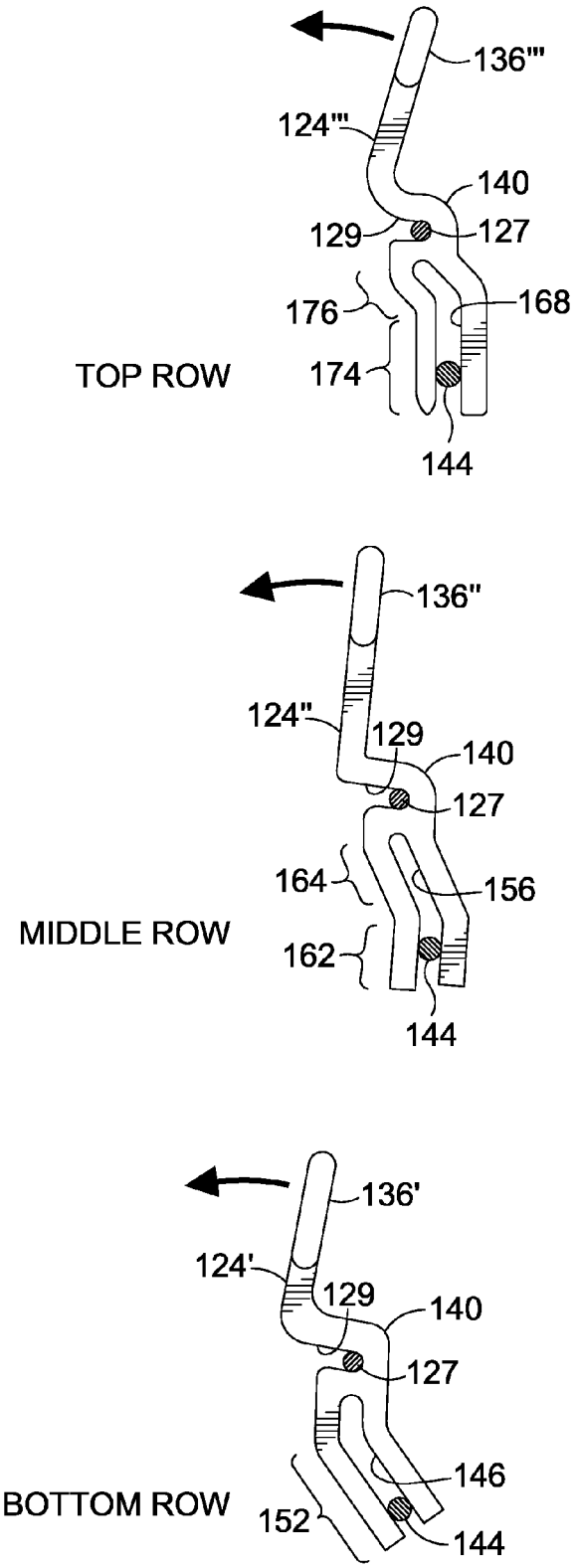
FIG. 7 is a side elevation view of three embodiments of exemplary petal attachment members having petal pivot slot guides in accordance with embodiments of the present invention.

FIG. 7 is a side elevation view of embodiments of the petal attachment members 124 for the bottom row 130 of petals, the middle row 132 of petals, and the top row 134 of petals. Beginning with the petal attachment member 124 for the bottom row 130 of petals ("124'"), the petal attachment member 124' includes a petal pivot slot guide 146', the petal pivot portion 140 and a paddle portion 136'. The petal pivot slot guide 146 has a first slanted-angle portion 152 and slidably receives one of the horizontal segments 144 associated with a bottom plane of horizontal segments 144. Because this is a side view, the horizontal segment 144 is seen in cross section. Similarly, the notch 129 of the petal attachment member 124' receives one of the rods 127 of the bottom row of the support structure 200 such that the petal attachment member 124' pivots thereon, as discussed below.

In a similar fashion, the petal attachment member 124 for the middle row 132 of petals "124''") includes a petal pivot slot guide 156, the petal pivot portion 140, and a paddle portion 136''. The petal pivot slot guide 156 has a first vertically-oriented portion 162 and a second slanted-angle portion 164. The petal pivot slot guide 156 slidably receives a horizontal segment 144 corresponding to a middle plane of horizontal segments 144 of the basket 143. The notch 129 receives one of the rods 127 of the middle row of the support structure 200.

Lastly, the petal attachment member 124 for the top row 134 of petals ("124'''") has a petal pivot slot guide 168, the petal pivot portion 140, and a paddle portion 136''. The petal pivot slot guide 168 includes a vertically-oriented portion 174, and a slanted-angle portion 176. The petal pivot slot guide 168 slidably receives a horizontal segment 144 corresponding to a top plane of the horizontal segments 144 of the basket 143. The notch 129 receives one of the rods 127 of the top row of the support structure.

Figure 8:
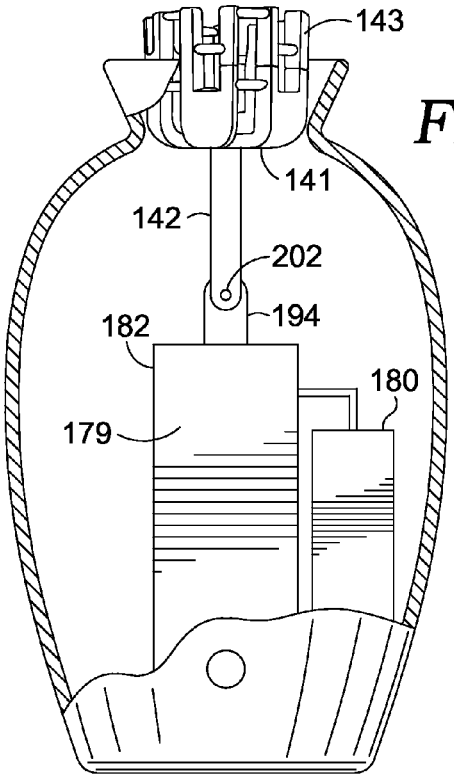
FIG. 8 is a partial cross-sectional, side elevation view of a vase having an exemplary power source and motion mechanism in accordance with embodiments of the present invention.

Turning to FIG. 8, a side elevation view, with the container 114 in partial cross-section, illustrates an exemplary motion mechanism 179 with a power source 180. The motion mechanism 179 moves the slidable pusher basket 141 longitudinally between first and second positions. FIG. 8 depicts the power source 180 as a battery operatively coupled to a gearbox assembly 182 of the motion mechanism 179. The gearbox assembly 182 will be discussed in more detail below with respect to FIGS. 9-10. The power source 180 and the motion mechanism 179 are both located or concealed within the hollow interior of the container 114. Although a battery coupled to a gearbox assembly 182 is one means to open and close the flower 100, other means are available and are within the scope of this invention. Such means may include manual operation, electrical operation, a material that expands when wetted (e.g., a compressed sponge the expands when wet and shrinks when dry), mechanisms powered by spring force (e.g., a wind up version with a crank and a spring or rubber band), a compressed fluid, materials that change shape when heated or cooled (e.g., use an electric current to heat a metal (such as muscle wire) that forms the stem of a petal and which changes shape when heated), and the like. Any and all such variations to the motion mechanism are within the scope of embodiments of the present invention.

FIG. 8 further depicts a shaft 194 extending from the gearbox assembly 182. The shaft 194 is operatively coupled on one end to a lower end of the slidable pusher shaft 142 by means of an engaging pin 202. An upper end of the slidable pusher shaft 142 is coupled with the pusher basket 143. The support structure 200, in which the pusher basket 143 is received, has been omitted from FIG. 8 for clarity.

Figure 9:
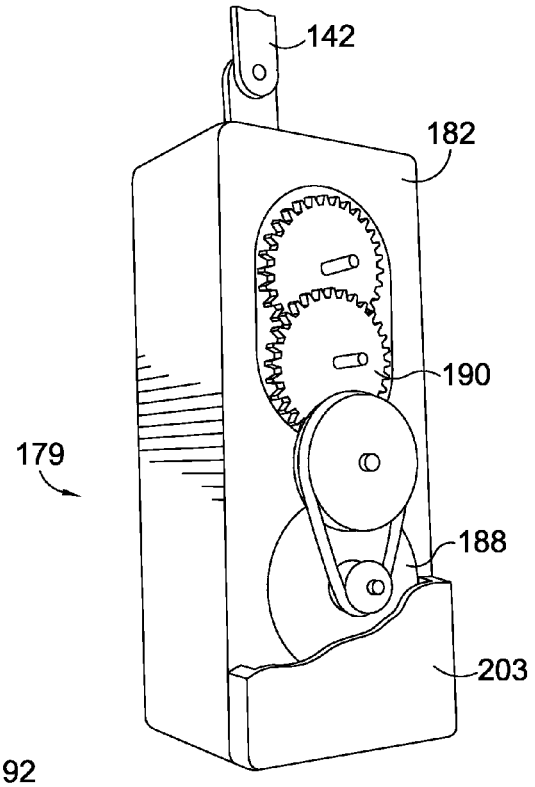
FIG. 9 is a perspective view of an exemplary gearbox assembly with a portion thereby cut away for clarity in accordance with embodiments of the present invention.

Turning to FIG. 9, a portion of a cover 203 has been cut away to reveal one possible arrangement of the gearbox assembly 182. FIG. 9 depicts a battery-operated motor 188 that is operatively coupled to a plurality of gears 190. In one embodiment, the battery-operated motor 188 operates at approximately 2000 rpm. The gearbox assembly 182 comprises a series of gears 190 with a gear reduction ratio (e.g., about 4 to 1) through each reduction. Taking into account all the gears in the gearbox assembly 182, the total gear reduction ratio can easily approach 750 to 1. These types of gearbox assemblies 182 are well known in the art and, as such, will not be further described herein.

Figure 10:
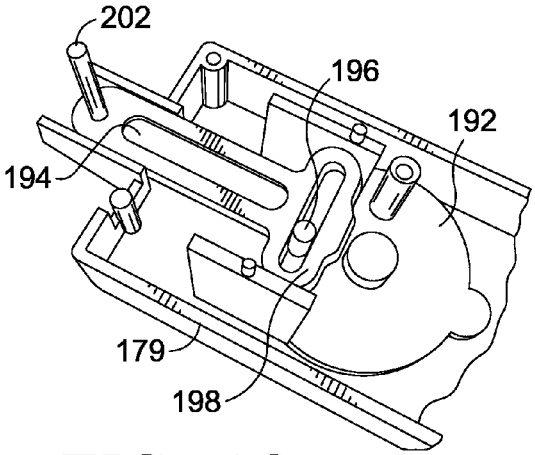
FIG. 10 is a fragmentary perspective view of a rear of the gearbox assembly of FIG. 9 with a portion thereof removed for clarity.

FIG. 10 illustrates a partial deconstructed view of a portion the gearbox assembly 182. In this arrangement, a final gear 192 is coupled with the shaft 194 via a wheel rod 196 extending up through a yoke 198 of the shaft 194. As well, the shaft 194 also includes an engaging pin 202 that engages with the lower end of the slidable pusher shaft 142. In one possible embodiment, the final gear 192 turns at a rate of about 180 degrees in approximately 10 seconds. This slowly raises the shaft 194 out of the motion mechanism 179 to open the flower 100.

To open the flower 100, in one embodiment, a user depresses the activating button 116 located on the container 114. Upon depressing the activating button 116, the battery 180 actuates the battery-operated motor 188 which initiates movement of the gears 190 in the gearbox assembly 182. The battery-operated motor 188 generates a rotary output that is translated into a reciprocating vertical linear motion of the slidable pusher basket 141 by means of the wheel rod 196 and the yoke 198.

As the slidable pusher basket 141 moves from a first position to a second position, it causes, for example, the horizontal segments 144 to exert an upward force on the petal attachment members 124. With respect to a petal attachment member 124' in the bottom row of petals and using FIG. 7 as a guide, as a horizontal segment 144 in the bottom plane of horizontal segments 144 begins to move upward, it is moved along the petal pivot slot guide 146. The horizontal segment 144 begins to exert an upward force on the member 124' opposite the slanted-angle portion 152 of the petal pivot slot guide 146. As the horizontal segment 144 continues to travel up the petal pivot slot guide 146 and continues to exert an upward force, the petal attachment member 124 begins to pivot around its petal pivot portion 140 in the direction of the arrow to a generally open position.

The middle row of petal attachment members 124'', however, will not begin to pivot open at the same time because the horizontal segments 144 in the middle plane of horizontal segments 144 are adjacent the vertically-oriented portions 162 of the petal pivot slot guides 156. Thus, no upward force is initially exerted on the petal attachment member 124''. As well, the third row of petal attachment members 124''' will also not yet begin to pivot open because the horizontal segments 144 in the top plane of horizontal segments 144 are adjacent the longer vertically-oriented portions 174 of the petal pivot slot guides 168.

As the slidable pusher basket 141 continues its ascent upwards, the middle row of petal attachment members 124" will begin to pivot open before the top row of petal attachment members 124'". This is because the vertically-oriented portions 162 of the petal pivot slot guides 156 are of a shorter length than the vertically-oriented portions 174 of the petal pivot slot guides 168. Because of this configuration, the horizontal segments 144 in the middle plane of horizontal segments will be adjacent the slanted-angle portions 164 before the horizontal segments 144 of the top row of horizontal segments 144 are adjacent the slanted-angle portions 176. Once the horizontal segments 144 of the middle plane of horizontal segments 144 are adjacent the slanted-angle portions 164, the upward force causes the petal attachment members 124" to pivot open. Likewise, once the horizontal segments 144 of the top plane of horizontal segments 144 are adjacent the slanted-angle portions 176, the upward force causes the petal attachment members 124'" to pivot open.

The relative opening angles of the bottom, middle and top rows of the flower 100 are determined by the relative configuration of the petal attachment members 124 of the respective rows and their slot guides. In one embodiment of the invention, the bottom row of petals 110 opens to approximately a 90 degree angle between the paddle portion 136' and the vertical members 126, the middle row of petals 110 opens to an angle between 85 degrees and 75 degrees between the paddle portion 136" and the vertical members 126, and the upper row of petals 110 opens to an angle between approximately 70 degrees and 55 degrees between the paddle portion 136'" and the vertical members 126.

When the user wishes to close the flower 100, the user again depresses the activating button 116 and the flower 100 begins to close by a reversal of the above-described method. Again, the relative closing angles of the bottom, middle, and top rows of the flower 100 are determined by a relative configuration of the petal attachment members 124 and the slot guides thereon. In one embodiment of the invention, the bottom row of petals 110 close to approximately a 10 to 15 degree angle between the paddle portion 136' and the vertical members 126, the middle row of petals 110 close to approximately a 5 to 10 degree angle between the paddle portion 136" and the vertical members 126, and the upper row of petals 110 close to an angle between approximately 0 degrees and 5 degrees between the paddle portion 136'" and the vertical members 126.

Many variations can be made to the illustrated embodiments of the present invention without departing from the scope of the present invention. Such modifications are within the scope of the present invention. For example, while the embodiments of the flower described have had multiple rows of petals that open at different angles, a similar realistic, natural blooming effect can be achieved by altering the opening angle and/or rate of individual petals on a single row of petals. Further, while the flower has been shown as being in a vase or container, the flower could take on the appearance of fresh cut flowers without the need for a vase. The motion mechanism could be inside the stem or concealed by the petals. Other versions could include a base giving the appearance of a window box planter. The base could include the motion mechanism and be covered with a top resembling dirt or grass with holes therein where users may insert the stems of flowers of their own choosing. The stems would couple with the motion mechanism inside the base which would power the opening of the flowers by transferring motion from inside the base up through the stem to the petal moving mechanism. Other modifications would be within the scope of the present invention.

The present invention has been described in relation to particular embodiments, which are intended in all respects to be illustrative rather than restrictive. Alternative embodiments will become apparent to those of ordinary skill in the art to which the present invention pertains without departing from its scope.

Various embodiments of the invention have been described to be illustrative rather than restrictive. Alternative embodiments will become apparent from time to time without departing from the scope of embodiments of the inventions. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A realistically opening flower, comprising:

a slidable pusher basket having an upper end and a lower end, the upper end comprising a plurality of vertical segments interconnected by a plurality of horizontal segments, at least two of the horizontal segments being on different geometric planes, wherein the slidable pusher basket is moveable from a first position to a second position in the direction of the upper end;

a means for moving the slidable pusher basket from the first position to the second position in the direction of the upper end, the means located generally adjacent to the lower end of the slidable pusher basket; and a simulated flower comprising: 1) a base support structure that receives the upper end of the slidable pusher basket, and 2) multiple rows of petal attachment members pivotably connected to the base support structure, at least two of the petal attachment members being on different geometric planes, each petal attachment member comprising at least a petal pivot slot guide;

wherein movement of the slidable pusher basket from the first position to the second position causes the petal pivot slot guide of the each petal attachment member to receive a respective horizontal segment of the slidable pusher basket thereby causing the each petal attachment member to transition from a generally closed position to a generally open position, and wherein each row of petal attachment members has a different open and closed angle from the others.

2. The realistically opening flower of claim 1, wherein the means for moving the slidable pusher basket from the first position to the second position includes a gearbox assembly with a battery-operated motor.

3. The realistically opening flower of claim 2, wherein the battery-operated motor is operatively coupled with a plurality of gears in the gearbox assembly and wherein the gearbox assembly is operatively coupled to the slidable pusher basket.

4. The realistically opening flower of claim 3, wherein the gearbox assembly translates a rotary output of the battery-operated motor into a reciprocating vertical linear motion and wherein the reciprocating vertical linear motion moves the slidable pusher basket between its first and second positions.

5. The realistically opening flower of claim 1, wherein the base support structure of the simulated flower has one or more sepals attached thereto.

6. The realistically opening flower of claim 5, wherein the sepals include fabric sepals.

7. The realistically opening flower of claim 1, wherein the multiple rows of petal attachment members further comprise fabric petals.

8. The realistically opening flower of claim 1, wherein the multiple rows of petal attachment members include three rows of petal attachment members, each row of petal attachment members on a different geometric plane from the others, each row of petal attachment members adapted to receive a different geometric plane of the plurality of horizontal segments, and wherein an uppermost row of petal attachment members has a smaller open angle than a lowermost row of petal attachment members.

9. The realistically opening flower of claim 8, wherein a middle row of petal attachment members has an open angle intermediate the uppermost and lowermost rows of petal attachment members.

10. The realistically opening flower of claim 1, wherein incident to the slidable pusher basket moving from the second position to the first position in the direction of the lower end, the multiple rows of petal attachment members transition from the generally open position to the generally closed position.

11. A realistically opening artificial flower, comprising;

a simulated flower comprising multiple rows of petals pivotably connected to a support structure, at least two of the rows being on different geometric planes, each petal having a petal attachment member, each petal attachment member having a petal pivot slot guide;

a slidable pusher basket having an upper end and a lower end, the upper end comprising a plurality of vertical segments interconnected by a plurality of horizontal segments, at least two of the horizontal segments being on different geometric planes, wherein the slidable pusher basket is moveable from a first position to a second position in the direction of the upper end, and wherein movement of the slidable pusher basket from the first position to the second position causes the petal pivot slot guide of the each petal attachment member to receive a respective horizontal segment of the plurality of horizontal segments of the slidable pusher basket thereby causing the each row of petals to open to a different opening angle; and a sentiment positioned adjacent to an uppermost row of petals, wherein the sentiment is concealed by at least one of the rows of petals when the multiple rows of petals are in a generally closed position, and wherein the sentiment is revealed when the multiple rows of petals are in a generally open position.

12. The realistically opening artificial flower of claim 11, wherein the sentiment is positioned on a holding platform attached to the support structure, and wherein the platform is movable vertically from a retracted position to a display position via the slidable pusher basket.

13. The realistically opening artificial flower of claim 11, wherein the hidden sentiment comprises a paper message.

14. The realistically opening artificial flower of claim 13, wherein the paper message is formed in such a way as to be folded in a substantially closed arrangement when the multiple rows of petals are in the generally closed position.

15. The realistically opening artificial flower of claim 14, wherein the paper message unfolds to an open arrangement when the multiple rows of petals assume the generally open position.

16. A realistically opening artificial flower, comprising:

a container having a side wall and a base wall, wherein the side wall and the base wall cooperate to define a hollow interior and wherein the container includes a top opening into the hollow interior;

a gearbox assembly positioned in the hollow interior of the container, the gearbox assembly having a plurality of gears and a battery-operated motor powered by a battery source;

a slidable pusher basket having an upper end and a lower end, the upper end comprising a plurality of vertical segments interconnected by a plurality of horizontal segments, and wherein the lower end is operatively coupled with the gearbox assembly, and wherein the slidable pusher basket is moveable via the gearbox assembly from a first position to a second position in the direction of the upper end; and a simulated flower support structure that receives the upper end of the slidable pusher basket, the simulated flower support structure having:

(1) a bottom row of petals having a first plurality of petal attachment members, wherein each of the first plurality of petal attachment members has a petal pivot portion that is pivotally hinged to the support structure and a petal pivot slot guide having a first slanted-angle portion that receives a first horizontal segment of the plurality of horizontal segments of the slidable pusher basket when the slidable pusher basket moves from the first position to the second position, (2) a middle row of petals having a second plurality of petal attachment members, wherein each of the second plurality of petal attachment members has a petal pivot portion that is pivotally hinged to the support structure and a petal pivot slot guide that receives a second horizontal segment of the plurality of horizontal segments of the slidable pusher basket when the slidable pusher basket moves from the first position to the second position, wherein the petal pivot slot guide has a vertically-oriented portion and a slanted-angle portion, and wherein the second horizontal segment is located vertically adjacent and above the first horizontal segment, and (3) a top row of petals having a third plurality of petal attachment members, wherein each of the third plurality of petal attachment members has a petal pivot portion that is pivotally hinged to the support structure and a petal pivot slot guide that receives a third horizontal segment of the plurality of horizontal segments of the slidable pusher basket when the slidable pusher basket moves from the first position to the second position, wherein the petal pivot slot guide has a vertically-oriented portion and a slanted-angle portion, and wherein the third horizontal segment is located vertically adjacent and above to the second horizontal segment.

17. The realistically opening artificial flower of claim 16, wherein the bottom, middle, and top row of petals are moveable between a generally open position and a generally closed position, wherein activation of the battery-operated motor moves the slidable pusher basket from the first position to the second position, thereby causing movement of the first, second, and third horizontal segments from a lower position to an upper position which results in the bottom, middle, and top rows of petals pivotally rotating to the generally open position via the first, second, and third plurality of petal attachment members, wherein an opening angle of the bottom, middle, and top rows of petals is determined by a relative configuration of the first, second, and third plurality of petal attachment members, wherein the bottom row of petals has a different opening angle than the middle row of petals, and wherein the middle row of petals has a different opening angle than the top row of petals.

18. The realistically opening artificial flower of claim 17, further comprising:

a sentiment positioned adjacent the top row of petals, wherein the sentiment is concealed by the bottom, middle, and top row of petals when the rows of petals are in a generally closed position and wherein the sentiment is revealed when the bottom, middle, and top row of petals are in a generally open position.

19. The realistically opening artificial flower of claim 17, wherein the first horizontal segment engages the slanted-angle portion of the petal pivot slot guide of the bottom row of petal attachment members prior to the second horizontal segment engaging the slanted-angle portion of the petal pivot slot guide of the middle row of petal attachment members and wherein the second horizontal segment engages the slanted-angle portion of the petal pivot slot guide of the middle row of petal attachment members prior to the third horizontal segment engaging the slanted-angle portion of the petal pivot slot guide of the top row of petal attachment members, whereby the bottom row begins to open before the middle row and whereby the middle row begins to open before the top row.

* * * * *